United States Patent [19]

Kusuda et al.

[11] Patent Number: 4,746,952

[45] Date of Patent: May 24, 1988

[54] DEVELOPING DEVICE

[75] Inventors: Toshiaki Kusuda, Osaka; Takeshi Tsuda, Sakai; Masakatsu Akashi, Yahata, all of Japan

[73] Assignee: Mita Industrial Co., Ltd., Osaka, Japan

[21] Appl. No.: 851,640

[22] Filed: Apr. 14, 1986

[30] Foreign Application Priority Data

Apr. 17, 1985 [JP] Japan ..... 60-82959

[51] Int. Cl.[4] ..... G03G 15/01; G03G 15/08

[52] U.S. Cl. ..... 355/4; 118/657; 355/3 DD

[58] Field of Search ..... 355/3 R, 3 DD, 4; 118/657, 658

[56] References Cited

U.S. PATENT DOCUMENTS

| | | | |
|---|---|---|---|
| 3,947,107 | 3/1976 | Smith | 355/3 DD |
| 3,987,756 | 10/1976 | Katayama et al. | 355/4 X |
| 4,007,707 | 2/1977 | Buchan et al. | 355/3 DD X |
| 4,077,358 | 3/1978 | Kito | 355/4 X |
| 4,089,297 | 5/1978 | Morita et al. | 355/3 DD X |
| 4,351,604 | 9/1982 | Karasawa et al. | 355/3 DD X |
| 4,431,298 | 2/1984 | Arai et al. | 355/3 DD |
| 4,496,240 | 1/1985 | Yamashita et al. | 355/3 DD X |
| 4,552,451 | 11/1985 | Yamazaki et al. | 355/3 DD X |

*Primary Examiner*—Fred L. Braun

*Attorney, Agent, or Firm*—Armstrong, Nikaido, Marmelstein & Kubovcik

[57] ABSTRACT

An apparatus for electrostatic latent image development having two or more units for multicolor development provided around a photoreceptor. Each unit has a developer feed controller for feeding developer to the developing section having a developing roller facing the photoreceptor drum and for shutting off the feeding and has a doctor blade in the feed up-stream in turning direction of the developing roller. Developer is applied to the developing section when development is performed by displacement of the developer feed controller and is shut off when the developing unit is not used for development.

6 Claims, 7 Drawing Sheets

DEVELOPING DEVICE

FIELD OF THE INVENTION AND RELATED ART STATEMENT

This invention relates to a developing device for electrostatic latent images on the photoreceptor of electrostatic copying machines and others, particularly the device having two or more developing units for multicolor development arranged around periphery of the photoreceptor.

Each developing unit of such developing device is provided with a developing roller to apply developer onto the photoreceptor. It is necessary to design such developing device so that the developing unit containing the developer for a required color is used and to keep the other units off the developing. If the developer is supplied to the developing roller of the units kept off the developing, unnecessary developer is deposited onto the photoreceptor, which makes the print quality lower. Various kinds of compositions have been proposed to prevent this.

The Official Gazzette of Japanese Patent Publication unexamined No. Sho. 54-109946, for example, shows a composition to control supply of developer to the developing roller by turning a magnetic roller provided in a rotary sleeve of the developing roller of the unit at non-developing by certain angle. In this case, however, it is necessary to provide a magnetic roller which turns as required in the rotary sleeve turning at a constant speed, which makes the composition very intricated.

By another contrivance, as shown in the Official Gazzette of Japanese Patent Publication unexamined No. Sho. 55-169160, supply of developer onto the photoreceptor is prevented by providing a developer scraping blade to prevent deposition of developer onto the developing roller near the developer outlet and in a manner so that the blade swings freely and apart from the scraper provided to scrap off the developer on the circumference of the developing roller after developing and by putting the top end of the scraping blade of the developing unit at non-developing in contact with periphery of the developing roller.

With a developing device of this composition, however, the developer scraped off by the blade is accumulated under the developing roller. As the developing roller turns, the accumulated developer is compressed causing block of toner and making deterioration of the carrier easier.

It happened, in some cases, that the developer is splashed around when the blade is separated from the developing roller and leaks out of the developing device through the opening for developing.

OBJECT AND SUMMARY OF THE INVENTION

In view of the foregoing this invention is to provide a developing device of simple composition, which can prevent the developer from being supplied to the developing roller of the developing unit at non-developing so that unnecessary developer may not be deposited onto the photoreceptor and that the print quality may not be lowered, and can prevent blocking of toner and deterioration of carrier.

To realize the object, the developing device of the invention is provided with a developer feed control means to supply developer to the developing unit or to shut off the supply so as to move within the range which does not come in contact with the developing roller and at the developer feed unit positioned at the upper stream side than the doctor blade of each developing unit in turning direction of the developing roller. At non-developing, supply of developer to the developing roller is prevented by operation of the feed control means.

DETAILED DESCRIPTION OF PREFERRED EMBODIMENTS

Figure 1:
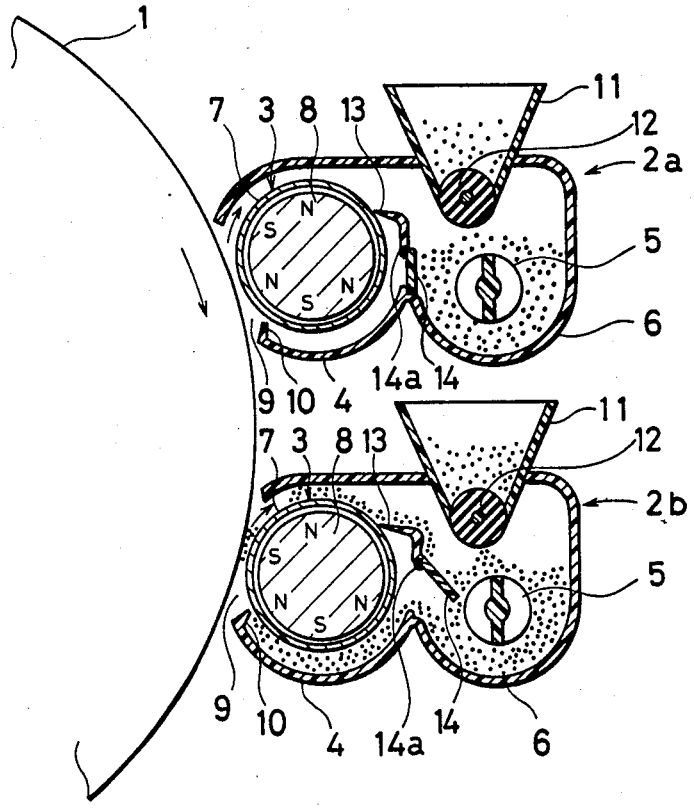
FIG. 1 is a sectional view showing the 1st embodiment of an electrostatic copying machine provided with the developing device of this invention.
Figure 2:
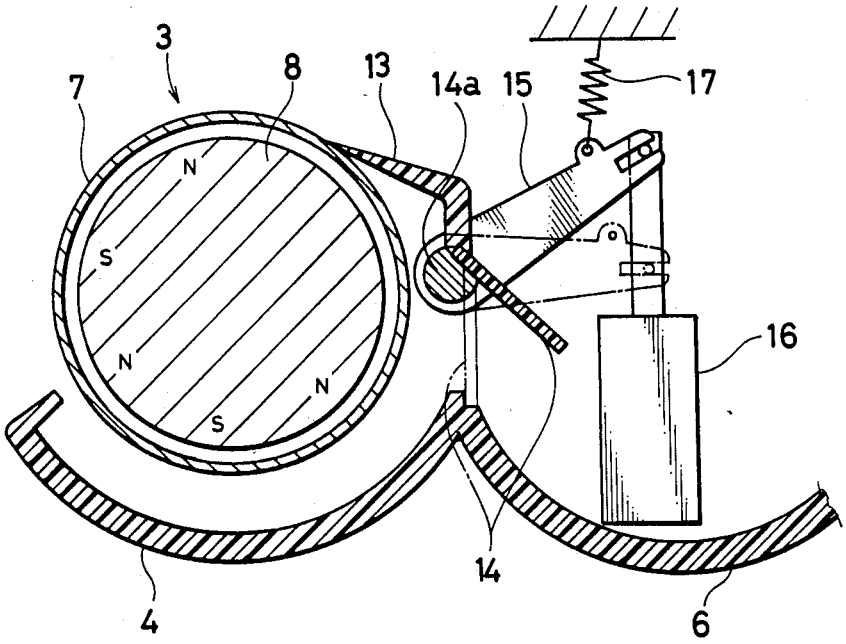
FIG. 2 is a sectional view to show the main part of developing device.

FIG. 1 and FIG. 2 show the main part of an electrostatic copying machine provided with the developing device of the 1st embodiment of this invention. In FIG. 1, 1 is a photoreceptor drum on which electrostatic latent images are formed, and two or more number of developing units *2a*, *2b* are arranged around the photorecepter drum 1, and developers of different colors are stored respectively in the housing of each developing unit *2a*, *2b* so that multicolor development of said electrostatic latent images is carried out.

The housing of said developing units *2a*, *2b* is composed of a developing roller housing part 4 in which the developing roller 3 is housed, and of a developer housing part 6 in which the stirring roller 5 is housed, and developer made of toner and carrier is kept in the developer housing part 6.

Developing roller 3 is composed of a cylindrical rotary sleeve 7 driven in clockwise direction in the drawing by a driving mean not illustrated and of a magnetic roller 8 having N poles and S poles magnetically attached to two or more number of positions in the roller with certain spacing, and the developer is deposited onto the surface of the rotary sleeve 7 by the magnetic force of this magnetic roller 8 forming a magnetic brush.

A doctor blade 10 to control thickness of the developer deposited onto the peripheral surface of the rotary sleeve of the developing roller is provided at the upstream side in turning direction of the developing roller 3 at the developing opening 9 of the housing. As the rotary sleeve 7 turns, the magnetic brush moves to come in contact with the surface of the photorecepter drum 1 at the developing opening 9 made at the front side of the developing roller housing 4 so as to develop the electrostatic latent image.

The area of the developing opening 9 of the developing roller 4 facing to the photoreceptor drum is the port for development. A toner hopper 11 is provided at the upper part of said developer housing unit 6, and the toner kept in the hopper is supplied through the feed roller 12 onto the stirring roller 5, then is carried to the developing roller housing 4 while being mixed with the developer in the developer housing 6.

Between the developing roller housing 4 at the developer feeder pistion at the up stream side of doctor blade 10, in the turning direction of the developing roller 3, and the developer housing 6, a scraper 13 is provided as shown in FIG. 2 to scrape the magnetic brush after development and to return the developer to the developer housing 6.

Under the scraper, a control plate 14 acts as the developer supply control means to control the flow of the developer from the developer housing 6 to the developing roller housing 4.

The control plate 14 is movable within the range of no contact with the developing roller 3 and is attached so as to swing freely around the rotary shaft 14*a*, and is so composed as to swing and move freely between the condition to flow developer and the condition to shut-off the flow through a lever 15 attached to the rotary shaft 14*a*, solenoid 16 comprising the driving unit as a part of the developer feed control means, and a spring 17.

When the solenoid 16 is not energized, the control plate 13 is held at inclined condition shown by continuous line by the tension of the spring 17 and developer flow gap is opened. When the solenoid 16 is energized, the lever 15 turns against the tension of the spring 17, and the developer flow gap between the developing roller housing 4 and the developer housing 6 is closed by the control plate 14 as shown by the phanthom line. To operate the copying machine of the above composition, the control plate 14 of either one of the developing units 2*a*, 2*b*, 2*b* for example, containing the developer of the color used for developing is set at open position, and the control plate 14 of the other developing unit 2*a* is set at closed position. Accordingly, new developer is not supplied from the developer housing 6 to the developing roller housing 4 of the developing unit 2*a* containing the developer of the color not used for the developing, and the developer in the developing roller housing 4 is returned to the developer housing 6 through the developing roller 3 and the scraper 13. Consequently, the developer in the developing roller housing runs out. This prevents supply and deposition of unnecessary developer onto the surface of the photoreceptor drum 1 and also prevents the print quality from being lowered.

The developer returned to the developer housing 6 is not subjected to any significant compression as is allowed to flow freely in the housing 6 without staying at one place. This effectively prevents blocking of toner in the developer or deterioration of carrier due to breakage. As there is no need to provide any scraping blade to scrape off the developer besides the scraper 13, it doesn't happen that the developing roller 3 is damaged on the peripheral surface by the blade or that the developer is deteriorated being pressed against the developing roller.

It is also possible to use driving means of prior art such as a stepping motor in place of said solenoid 16 as the driving unit to swing said control plate 14. To the developing device described in the above embodiment, the developer of two components comprising toner and carrier is used. The composition of this invention, however, is also application to a developing device using one component developer made of magnetic toner. The same is true with the examples of embodiments described in the following text.

Figure 3:
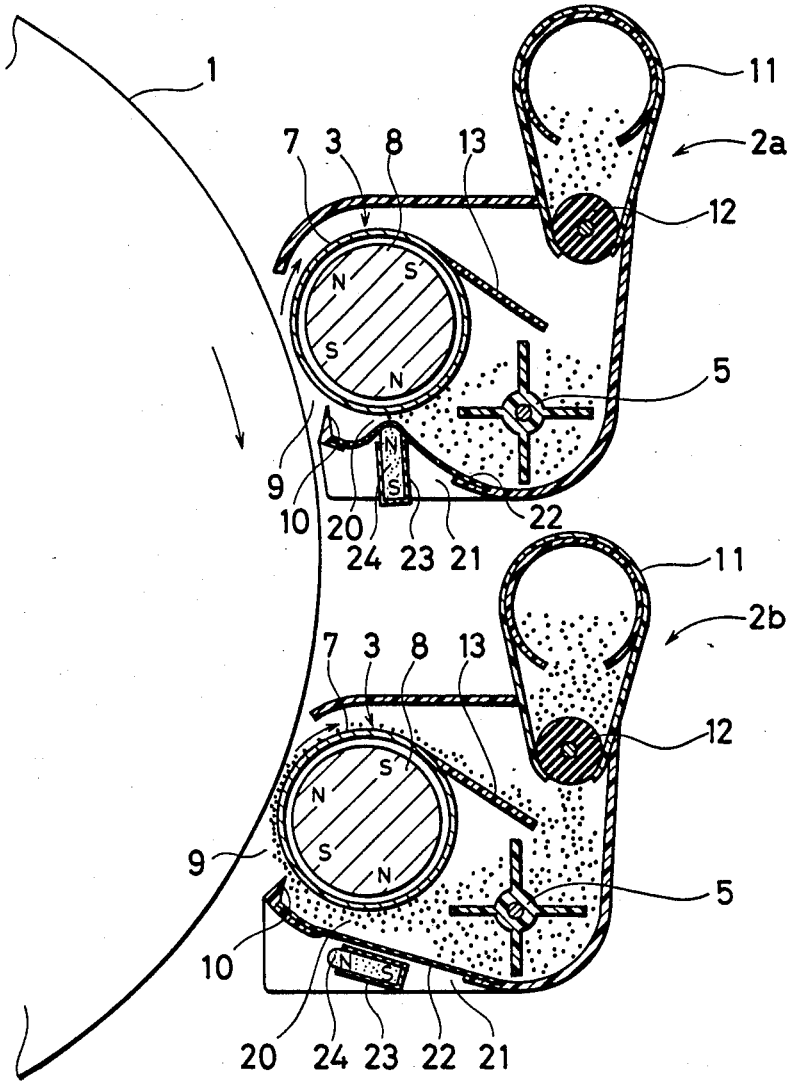
FIG. 3 is a sectional view showing the 2nd embodiment of an electrostatic copying machine provided with the developing device of this invention.

FIG. 3 shows the developing section of an electrostatic copying machine having two developing units 2*a*, 2*b* of the 2nd embodiment of this invention positioned vertically.

Each one of said developing units 2*a*, 2*b* comprises a housing containing developer of two components of toner and carrier, a developing roller 3 provided facing to the photoreceptor drum 1 on which electrostatic latent images are formed, a stirring roller 5 installed in parallel to the developing roller 3, and a scraper 13 to scrape toner after developing and provided above the stirring roller 5. Developers of different colors are housed respectively in the housing of the developing units 2*a*, 2*b* for multi-color development of the electrostatic latent image on the photoreceptor drum.

The developing roller 3 is composed of a cylindrical rotary sleeve 7 turned by a driving means not illustrated in opposite direction to the photoreceptor drum 1, and a stationary magnetic roll 8 inside the rotary sleeve and having N and S poles fixed magnetically on the periphery with certain spacing. The developer is deposited by the magnetic force of the magnetic roller 8 onto the surface of the rotary sleeve 7 to form a magnetic brush. As the rotary sleeve 7 turns, the magnetic brush moves and comes in contact with the photoreceptor drum 1 at the opening for developing 9 of the housing to develop said electrostatic latent image. On the bottom of the housing, a doctor blade 10 is projected to control the height of the magnetic brush.

The toner kept in the toner hopper at the upper part of the housing is supplied onto the stirring roller 5 through the feed roller 12, then is carried to the developing roller 3 while being mixed with the developer in the housing by the stirring roller 5. The developer carried by the stirring roller is deposited onto the surface of the rotary sleeve 7 to form a magnetic brush at the position corresponding to the N pole formed under the magnetic roller 8, i.e. at the developer feed section 20 positioned at the up-stream side of doctor blade 10 in the turning direction of developing roller 3.

Figure 4:
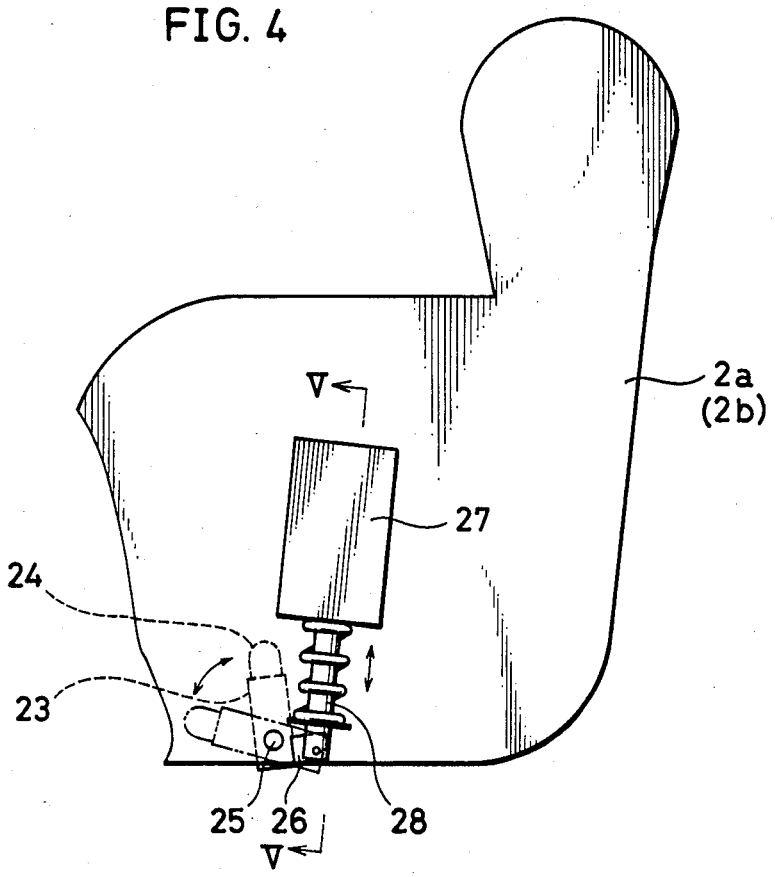
FIG. 4 is a side view of the developing device.
Figure 5:
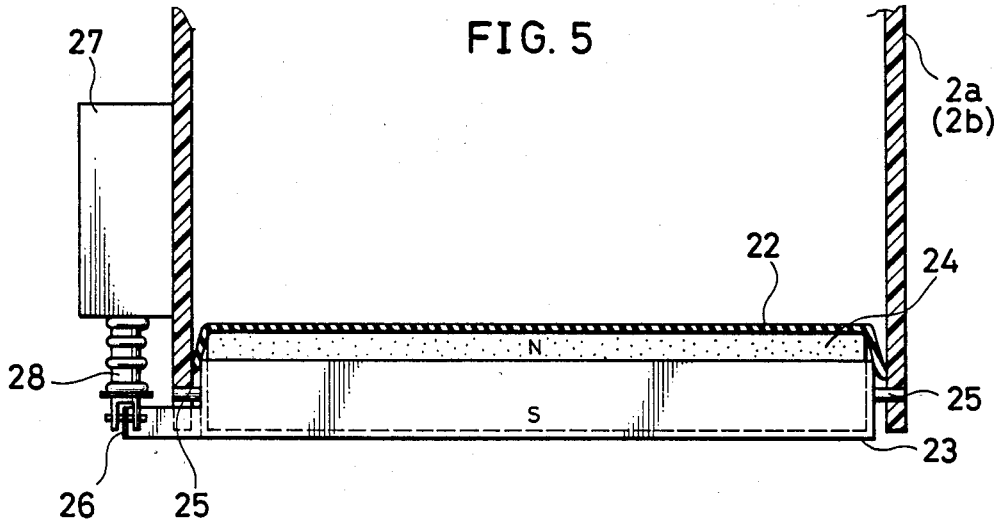
FIG. 5 is to show V—V section of FIG. 4.

A notch 21 is formed at a part of the bottom plate of the housing and in the range corresponding to the developing roller 3, and the notch 21 is covered with an elastic body 22 such as rubber plate. Under the elastic body 22, a magnet 24 as developer feed control means is placed facing to the developer feed section 20. As shown in FIG. 4 and FIG. 5, the magnet 24 is supported by the pins 25, 25 projecting at both ends of the holder 23 so as to turn freely and is turned by an operating means 27 comprising the solenoid as a part of the developer feed controller interlocked with the lever 26, which is inserted into the base of the holder 23.

The holder 23 is turned around the pins 25, 25 by turning on and off the operating means 27 to move up and down the operating lever 28 of the solenoid and the magnet 24 falls down along the lower face of the elastic body 22 to change the position between the condition where the N pole at the top end is kept off the developer feed section 20 (see the developing device 2*b* at the lower part of FIG. 3) and the condition where the magnet 24 rise to push up the elastic body 22 and the N pole at the top end comes close to the developer feed section 20 (see the developing device 2*a* at the upper part of FIG. 3).

To operate a copying machine of the above composition, the magnet 24 of the developing unit containing the developer of the color used for the development is set at the above described off position from the developer feed section and the magnet 24 of the other developing unit is set at the close position to the developer feed section. By this setting, the magnetic drawing force of the developing roller at the developer feed section of the developing unit containing the developer of the color not used for the developing is lowered by the magnetic force of the magnet 24, and quantity of the developer deposited on the pheriperal surface of the developing roller 3 is greatly reduced. As the result, the magnetic brush is not formed to enough height to come in contact with the surface of the photoreceptor drum thus preventing lowering of the print quality due to deposition of the developer of the color not used onto the surface of the photoreceptor drum 1.

When a part of the bottom plate of the housing is made of elastic body 22, like in the case of the above embodiment, and the elastic body 22 is pushed up by a magnet 24, in particular, deposition of the developer onto the developing roller 3 can be reduced effectively because of the multiple effect of blocking by the projected elastic body and of the reduced magnetic drawing by the magnet 24.

The magnet 24 is placed under the developer feed section 20. By this arrangement, the developer is not pressed against the blade like in the case of conventional device where the developer is scraped off forcefully by a scrape blade.

This effectively prevents blocking of toner in developer due to coagulation and also deterioration of carrier by breakage. This composition is also free from the trouble of developer splashed to the outside by swing motion of the blade when provided in the housing so as to swing freely.

Figure 6:
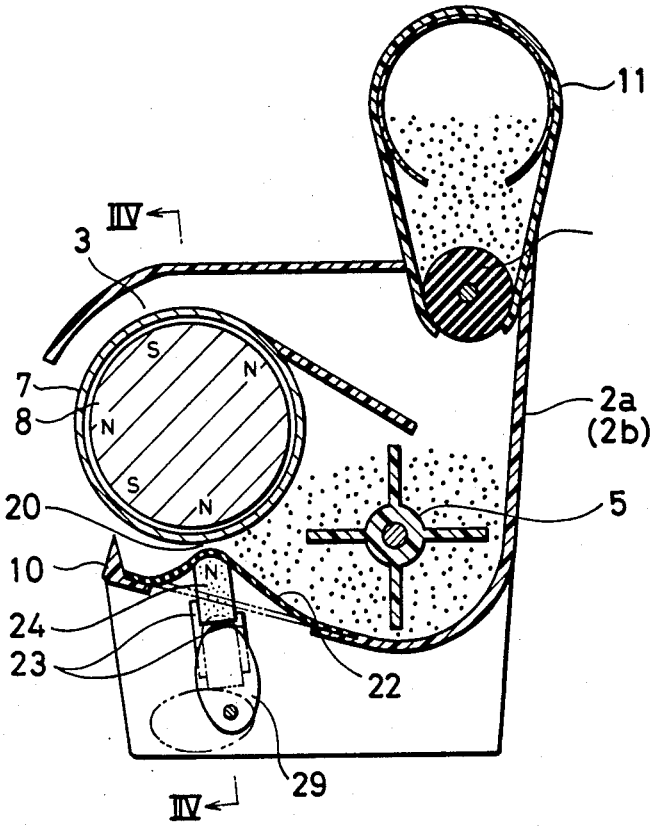
FIG. 6 is a sectional view showing the 3rd embodiment of the developing device.
Figure 7:
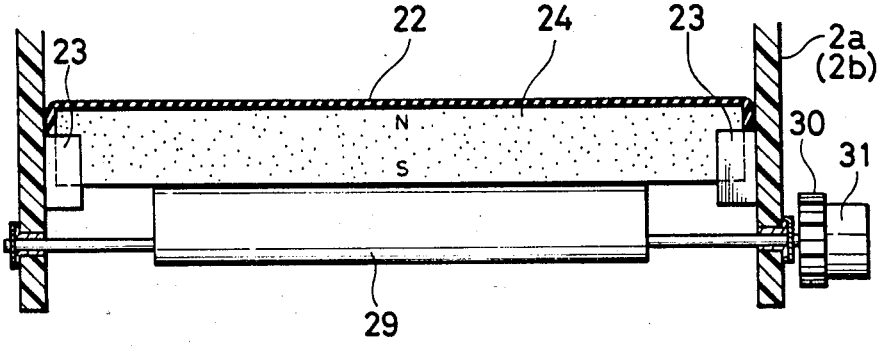
FIG. 7 is to show IIV—IIV section of FIG. 6.

FIG. 6 and FIG. 7 show the 3rd embodiment of this invention, in which the magnet 24 is held by the guide member 23 so as to move up and down freely under the developer feed section 20 of the housing, and the cam 29 as a part of the developer feed control means is provided under the magnet 24 so as to turn freely.

The driving power of the gear 30 at the end of the cam 29 is turned on and off through the magnetic clutch 31 to turn the cam 29 as required, and the magnet 24 is moved up and down through the cam.

In the above 2nd and 3rd embodiments, electrodes of the same polarity (N poles in the drawings) are provided at the developer feed section 20 of the developing roller 3 and at the top end of the magnet 24 facing to the section, and the magnetic drawing motion of the developing roller 3 is lowered effectively by the magnetic repulsion between the two poles while the roller is not used for development.

If the magnetic force of the magnet 24 is far more greater than that of the magnetic roller 8 of the developing roller 3 and major portion of developer is drawn to the side of the magnet 24, however, the two poles may be of different polarity each other because the magnetic drawing force of the developing roller 3 is lowered as the result of the greater power of the magnet 24 and the effect of this invention can be attained.

When the spacing between the bottom of the housing and the developing roller 3 is set smaller so that the magnetic force is fully applied to the developer feed section 20 when the magnet 24 comes close, there will be no need to raise the bottom by using the eastic body 22 for a part of the bottom plate.

This invention is also applicable to the developing device of which developing roller 3 turns in the same direction as that of the photoreceptor drum 1. In this case, the developer feed section is formed over the developing roller 3, and the magnet 24 is positioned at the upper part of the housing, or the magnet 24 is positioned in the same manner as the above embodiments and the developing roller 3 is turned in reverse direction during the time of no development.

Figure 8:
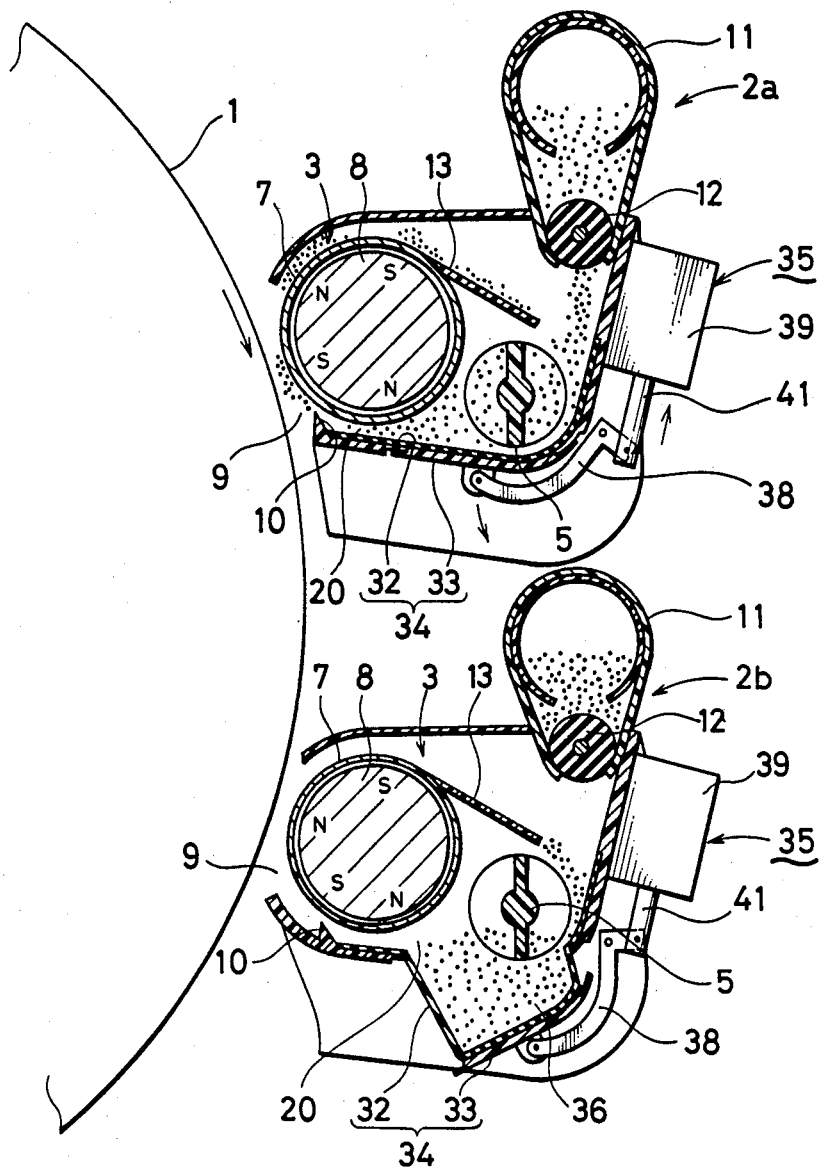
FIG. 8 is a sectional view of the 4th embodiment of an electrostatic copying machine provided with the developing device of this invention.

FIG. 8 shows the developing of an electrostatic copying machine or others with two developing units *2a, 2b* arranged vertically as the 4th of the present inventioned. The developing units *2a, 2b* respectively comprise a housing containing developer of two components of toner and carrier, a developing roller 3 provided facing to the photoreceptor drum 1 on which electrostatic latent image is formed, a stirring roller 5 arranged in parallel to the developing roller 3, and a scraper 13 for toner scraping after development and provided over the stirring roller 5.

The housing of each developing unit *2a, 2b* contains developer of different color for multi-color development of the electrostatic latent image on the photoreceptor drum 1.

The developing roller 3 is composed of a cylindrical rotary sleeve 7 turned in reverse direction to the photorecepter drum 1 by a driving means not illustrated, and a fixed type magnetic roller 8 provided in the rotary sleeve and having two or more N poles and S poles magnetically fixed on the periphery with certain spacing.

By the magnetic force of the magnetic roller 8, developer is deposited onto the surface of the rotary sleeve 7 to form magnetic brush. The magnetic brush moves as the rotary sleeve 7 turns and is put in contact with the surface of the photoreceptor drum 1 at the opening 9 for development of the housing to develop the electrostatic latent image. A doctor blade 10 to control the height of the magnetic brush is projected at the bottom of the housing.

The toner kept in the toner hopper 11 at the upper part of the housing is supplied onto the stirring roller 5 through the feed roller 12 and is carried to the developing roller 3 while being mixed with the developer in the housing by the stirring roller 5.

The developer carried by the stirring roller is deposited onto the surface of the rotary sleeve 7 to form magnetic brush at the position corresponding to the N pole made under the magnetic roller 8, i.e. at the developer feed section 20 positioned at the up-stream side of the doctor blade 10 turning in the direction of the developing roller 4.

The bottom of the housing is notched in the range from the developer feeding section 20 to the lower part of the stirring roller, and the notch is covered with an elastic member 32 made of rubber or the like.

A reinforcing plate 33 is provided under the elastic member 32, the bottom plate 34 made of the elastic member 32 and the reinforcing plate 33 is moved up and down by a driving means 35, and a hollow 36 is formed when the bottom plate 34 is lowered comprising a developer feed control means.

Figure 9:
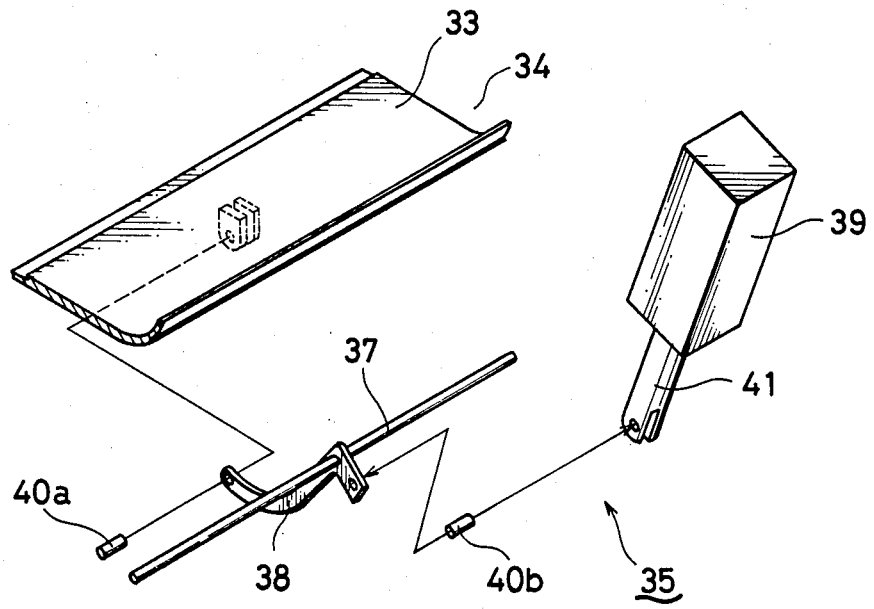
FIG. 9 is a perspective side view showing composition of the operating members.

As shown in FIG. 9, the driving means 35 is composed of a lever 38 held by a supporting shaft 37 to a side of the housing so as to turn freely, and a solenoid 39 as the driving source of the lever 38. One end of the lever 38 is connected to the lower face of the reinforcing plate by a pin *40a*, and the other end of the lever 36 is connected to the operating lever 41 of the solenoid 39 by a pin 40*b*.

The operating lever 41 of the solenoid 39 is pushed in and out, which turns the lever 38 so that the bottom plate 34 is displaced between the condition where the elastic member 32 is expanded to lower the bottom plate 34 (See the developing unit 2*b* at lower part of FIG. 8) and the condition where the elastic member 32 is contracted to raise the bottom plate 34 of the housing (See the developing unit 2*a* at the upper part of FIG. 8).

To operate a copying machine of the above composition, the bottom plate 34 of the housing 2*a* of the unit containing the developer of the color used for developing is set at raised position, and the bottom plate 34 of the housing 2*b* of the other unit is set at lowered position. By this setting, the developer of the color not used for the development flows into the hollow 36 made when the bottom plate 34 of the housing goes down and is kept off the developer feed section 20 of the developing roller 3. Consequently, the developer drawing force of the developing roller 3 does not reach the developer and no magnetic brush is formed on the periphery of the developing roller, which prevents lowering of the print quality due to deposition of developer of the color not used for the development on the surface of the photoreceptor drum.

The developer flew into the hollow 36 is not subjected to any compression as it is kept off the developing roller, which serves to effectively prevent blocking of the toner in the developer due to coagulation and also deterioration of the carrier by breaking.

In addition, the developer is also free from such troubles as splashing to outside by the up-down motion of the bottom plate 34 because the up-down motion takes place at a position away from the opening 9 for development.

In the above embodiment, a part of the bottom plate 34 is made of the elastic member 32 such as rubber and the bottom plate 34 is moved up and down by using elastic property of rubber material. It may also possible to provide a bellows at a part of the bottom plate in place of the rubber material and to use expansion and contraction of the bellows for up-down motion of the bottom plate.

It may also possible to use a flexible material such as soft plastic for the bottom plate, to deform one end of the bottom plate in hinge form, and to hold the other end so as to slide freely along the side wall of the housing allowing the bottom plate to move up and down freely.

The developing device of any one of the above embodiments of the invention is not limited to the type with fixed magnetic roller of the developing roller 3. The invention is also applicable to such developing devices where both the sleeve and the magnetic roller are rotary type or where the sleeve is stationary and the magnetic roller is rotary type.

What is claimed is:

1. A developing device having two or more developing units arranged around a photoreceptor drum, each developing unit of said developing units developing an image of different color on said drum than the color of the image developed on said drum by the other of said developing units, each said developing unit being composed respectively of a housing for containing a developer of a selected color and a stirring roller and a housing for accommodating a developing roller, a developing roller in said developing roller housing facing said photoreceptor drum for transferring said developer from said housing to said drum and a doctor blade for controlling the thickness of the developer deposited on the peripheral surface of said developing roller, and characterized by developer feed control means in each said developing unit at the up-stream side of said developing roller relative to said doctor blade and pivoted between said developer housing and said developing roller housing and movable toward and away from said developing roller without contacting said developing roller for feeding developer to said developing roller facing said photoreceptor drum when an image of the selected color is to be developed on said drum and for shutting off supply of said developer to said drum when development of an image of said selected color on said drum is not required.

2. A developing device according to claim 1, having a scraper between said developing roller housing and said developer housing for scraping developer remaining on the periphery of said developing roller and for returning said scraped developer to said developer housing and said developer feed control means is positioned between said developer housing and said developing roller housing for controlling the flow of said developer of a selected color to said developing roller housing, said developer feed control means including a control plate displaced between said developer feed position and said developer shut-off position and a driving unit for moving said control plate.

3. A developing device having two or more developing units arranged around a photoreceptor drum, each developing unit of said developing units developing an image of different color on said drum than the color of the image developed on said drum by the other of said developing units, each said developing unit being composed respectively of a housing having an elastic body in the bottom thereof for containing a developer of a selected color, a developing roller in said housing facing said photoreceptor drum for transferring said developer from said housing to said drum and a doctor blade for controlling the thickness of the developer deposited on the peripheral surface of said developing roller, a magnet movably provided under the elastic body of each said developing unit, and an operation control means connected to said magnet for moving said magnet so as to push up said elastic body to shut off supply of said developer to said drum when development of an image of said selected color on said drum is not required.

4. A developing device as set forth in claim 3, in which said developing roller is magnetic and the pole end of said magnet facing said developing roller and said developing roller are of the same polarity and the magnetic repulsion acting between the poles of said magnet and said roller reduces the magnetic drawing force of said developing roller when said developers feed is shut-off.

5. A developing device having two or more developing units arranged around a photoreceptor drum, each developing unit of said developing units developing an image of different color on said drum than the color of the image developed on said drum by the other of said developing units, each said developing unit being composed respectively of a housing for containing a developer of a selected color, a developing roller in said housing facing said photoreceptor drum for transferring said developer from said housing to said drum and a doctor blade for controlling the thickness of the developer deposited on the peripheral surface of said developing roller, and characterized by developer feed control means in each said developing unit at the up-stream side of said developing roller relative to said doctor blade and movable toward and away from said developing roller to feed developer to said developing roller facing said photoreceptor drum when an image of the selected color is to be developed on said drum and for shutting off supply of said developer to said drum when development of an image of said selected color on said drum is not required, said developer feed control means including a magnet and an operation control means connected to said magnet for moving said magnet toward and away from said developing roller for feeding and shutting off said developer feed, a part of the bottom of said developer housing is of an elastic member which can be raised and lowered to control said developer feed to said developing roller.

6. A developing device according to claim 5, wherein said developer feed control means includes driving means for raising and lowering said elastic member for increasing and decreasing said developer feed to said developing roller.

* * * * *